US007800005B2

(12) United States Patent
Tsao

(10) Patent No.: US 7,800,005 B2
(45) Date of Patent: Sep. 21, 2010

(54) THIN KEYPAD ASSEMBLY

(75) Inventor: Kai-Jie Tsao, Taoyuan (TW)

(73) Assignee: ICHIA Technologies, Inc., Taoyuan (TW)

( * ) Notice: Subject to any disclaimer, the term of this patent is extended or adjusted under 35 U.S.C. 154(b) by 0 days.

(21) Appl. No.: 12/570,177

(22) Filed: Sep. 30, 2009

(65) Prior Publication Data

US 2010/0013776 A1 Jan. 21, 2010

Related U.S. Application Data

(62) Division of application No. 11/673,640, filed on Feb. 12, 2007.

(51) Int. Cl.
*H01H 9/00* (2006.01)

(52) U.S. Cl. ..... 200/314; 200/512

(58) Field of Classification Search ..... 200/312
See application file for complete search history.

(56) References Cited

U.S. PATENT DOCUMENTS 6,399,903 B1 * 6/2002 Stevenson ..... 200/5 A
6,926,420 B2 * 8/2005 Sung ..... 362/629
7,414,210 B2 * 8/2008 Clegg et al. ..... 200/314
7,585,098 B2 * 9/2009 Mikami ..... 362/608
7,724,320 B2 * 5/2010 Hsieh ..... 349/62
2005/0056531 A1 * 3/2005 Yu et al. ..... 200/310
2007/0286556 A1 * 12/2007 Kassamakov et al. ..... 385/88
2009/0107824 A1 * 4/2009 Ou ..... 200/5 A
2009/0260969 A1 * 10/2009 Yasui ..... 200/5 A

* cited by examiner

*Primary Examiner*—Renee Luebke
*Assistant Examiner*—Lisa Klaus
(74) *Attorney, Agent, or Firm*—Chun-Ming Shih; HDLS IPR Services

(57) ABSTRACT

A thin keypad assembly includes a panel, a lining sheet and a light-guiding layer. The panel has hollowed numerals, letters, various symbols, a navigation-key pattern, a dialing pattern and an ending pattern, and grooves formed between keys. The lining sheet is disposed on the panel and has a navigation-key pattern thereon. The navigation-key pattern has a light-shielding layer and light-transmitting positions thereon, and the light-shielding layer has a light-reflecting layer thereon. The light-guiding layer is disposed on the lining sheet, and the position thereof corresponds to the key having a plurality of light-guiding micro structures and projecting bodies. The light-guiding layer, light-shielding layer and the light-reflecting layer extend onto the surface of the panel through the grooves.

8 Claims, 17 Drawing Sheets

THIN KEYPAD ASSEMBLY

This application is a divisional application of U.S. patent application Ser. No. 11/673,640, filed on Feb. 12, 2007.

BACKGROUND OF THE INVENTION

1. Field of the Invention

The present invention relates to a keypad assembly, and in particular to a thin keypad assembly.

2. Description of Prior Art

With the continuous progress of communication technology, many electronic products tend to be made compact, thereby to reduce the size and weight thereof and facilitate a user to carry. In order to reduce the size and weight of the electronic product, the volume of the internal integrated circuit has to be reduced. In addition, the area and thickness of the keypad acting as an operational interface of the electronic product should be also reduced, so that it can be easily mounted in a communication device.

U.S. Pat. No. 7,070,349 B2, entitled "THIN KEYPAD AND COMPONENTS FOR ELECTRONICS DEVICES AND METHODS" and shown in FIG. 16, discloses a conventional keypad assembly, in which after the keypad is assembled, a seam B exists between the key layer A and key layer A on the keypad. Although the seam B will not affect the operation of neighboring keys, foreign matters (such as dust or fine particles) are easily filled into the seam, affecting the smoothness in pressing the keys. Alternatively, water may penetrate into the electronic product through the seam, causing the poor contact of the circuit board and the corrosion damage of the components.

Further, Taiwan Patent No. I252159, entitled "KEYPAD MODULE STRUCTURE AND THE METHOD FOR MAKING THE SAME" and shown in FIG. 17, emphasizes that the gap E (hollowed portion) between a displaying body C and a key body D is reduced to be less than 0.01 mm, thereby to increase the aesthetic appearance and tightness. Although the gap E between the displaying body C and the key body D is reduced, after a long-term use, foreign matters may be still filled therein. Even, water may penetrate into the electronic product through the gap, causing the poor contact of the circuit board and the corrosion damage of the components.

SUMMARY OF THE INVENTION

The present invention is to provide a thin keypad assembly with no seams and contamination between the keys, by which the foreign dust, fine particles and water cannot penetrate into the keypad, and thus the surface of the keypad is often kept clean.

In order to achieve the above objects, according to the present invention, a thin keypad assembly includes a panel, a lining sheet and a light-guiding layer.

The panel has hollowed numerals, letters, various symbols, a navigation-key pattern, a dialing pattern and an ending pattern, and grooves formed between keys.

The lining sheet is disposed on the panel and has a navigation-key pattern thereon. The navigation-key pattern has a light-shielding layer and light-transmitting positions thereon, and the light-shielding layer has a light-reflecting layer thereon.

The light-guiding layer is disposed on the lining sheet, and the position thereof corresponds to the key having a plurality of light-guiding micro structures and projecting bodies.

The light-guiding layer, light-shielding layer and the light-reflecting layer extend onto the surface of the panel through the grooves.

DETAILED DESCRIPTION OF THE INVENTION

The technical contents and detailed description of the present invention will be explained with reference to the accompanying drawings.

Figure 1:
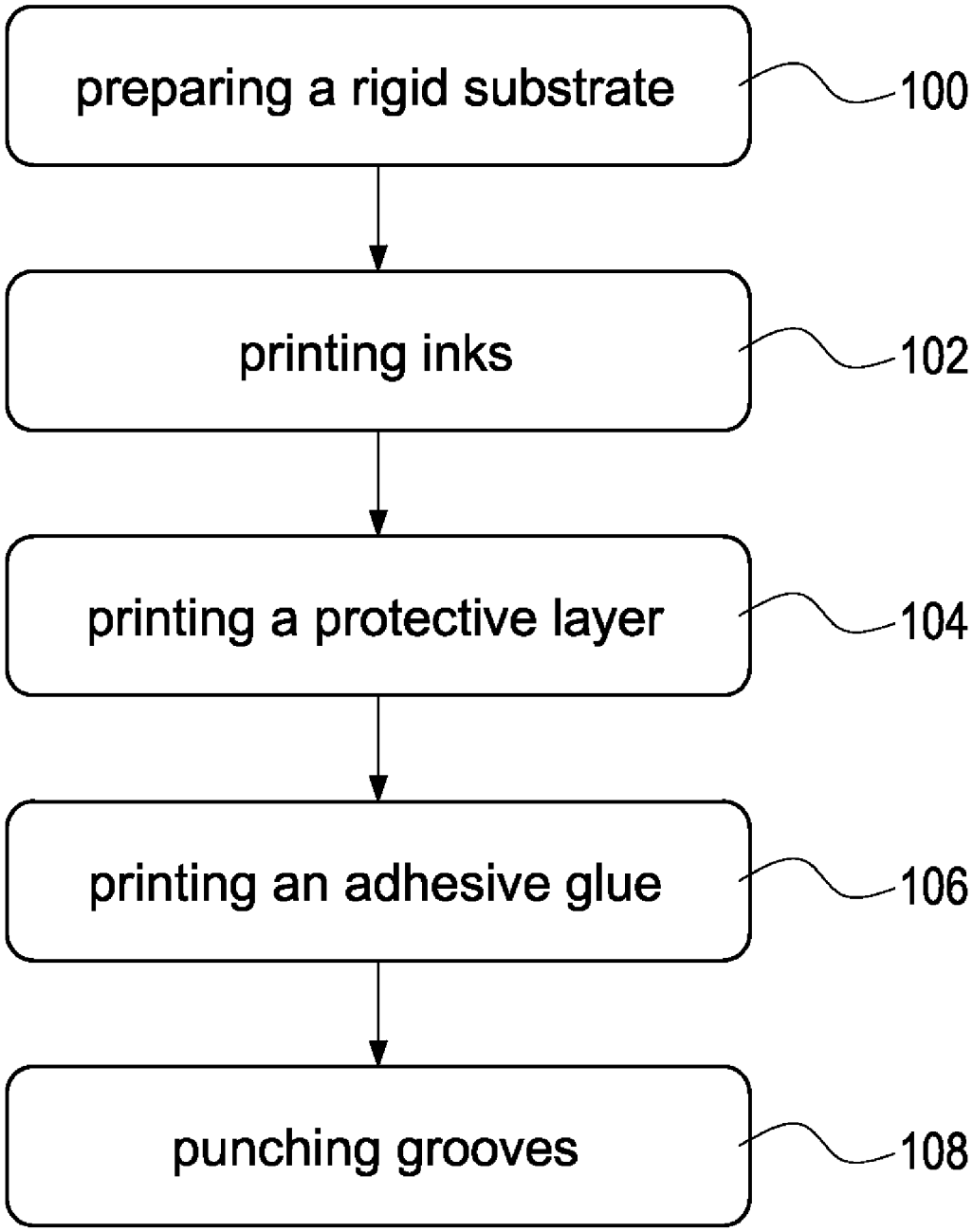
FIG. 1 is a schematic view showing the manufacturing process of the keypad panel of the present invention.
Figure 2:
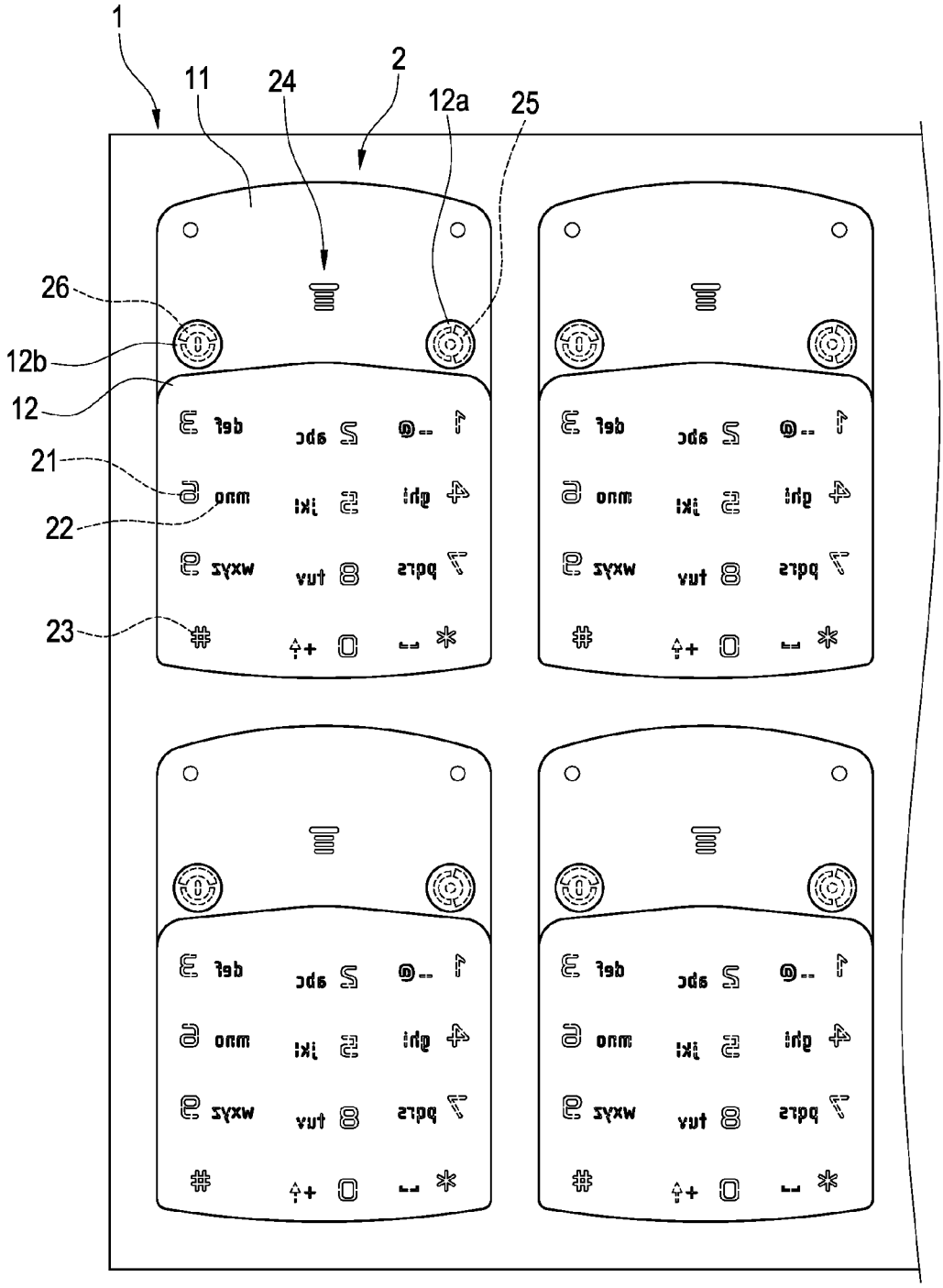
FIG. 2 is a front view of the keypad panel of the present invention.

FIG. 1 is a schematic view showing the manufacturing process of the keypad panel of the present invention, and FIG. 2 is a front view of the keypad panel of the present invention. It can be seen that these drawings disclose a method for manufacturing a thin keypad panel. First, in the step 100, a transparent hard substrate 1 is prepared. The hard substrate 1 is a PC film plastic material.

In the step 102, a first layer 11 of black ink is printed on the surface of the hard substrate to form a plurality of panels 2, while the panels 2 are made to have hollowed numerals 21 ("0", "1", "2" . . . "9"), English letters 22, various symbols 23, a navigation-key pattern 24, a dialing pattern 25 and an ending pattern 26. The numerals 21, English letters 22 and various symbols 23 on the first layer 11 are printed thereon with a second layer 12 of white ink, so that the numerals 21, English letters 22 and various symbols 23 can represent a white form. Similarly, the second layer 12*a* of the dialing pattern 25 is printed thereon with green ink, so that the dialing pattern 25 can represent a green form. The second layer 12*b* of the ending pattern 26 is printed thereon with red ink, thereby to represent a red form.

Figure 3A:
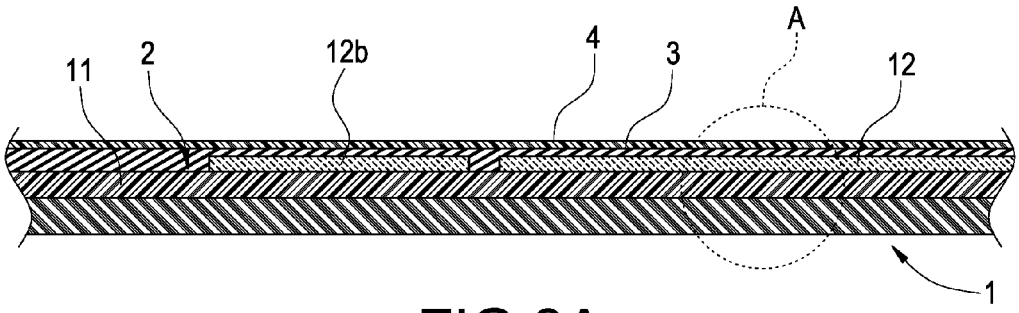
FIG. 3A is a side view of the keypad panel of the present invention.
Figure 3B:
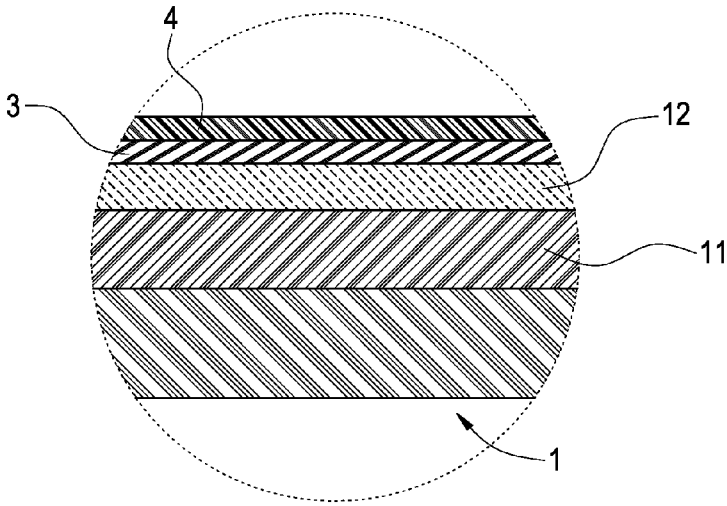
FIG. 3B is a partially enlarged view of FIG. 3A.

With reference to FIGS. 3A and 3B, in the step 104, a protective layer 3 is printed on the first layer 11 of black ink, the second layer 12 of white ink, the second layer 12*a* of green ink and the second layer 12*b* of red ink, respectively. Transparent ink is printed on the numerals 21, English letters 22, various symbols 23, the navigation-key pattern 24, the dialing pattern 25 and the ending pattern 26 to form the protective layer 3. The protective layer can prevent the black, white, green and red inks from damaging.

With reference to FIGS. 3A and 3B, in the step 106, a layer of adhesive glue 4 is printed on the surface of the protective layer 3. The adhesive glue 4 can be adhered to a lining sheet during the subsequent process.

Figure 4:
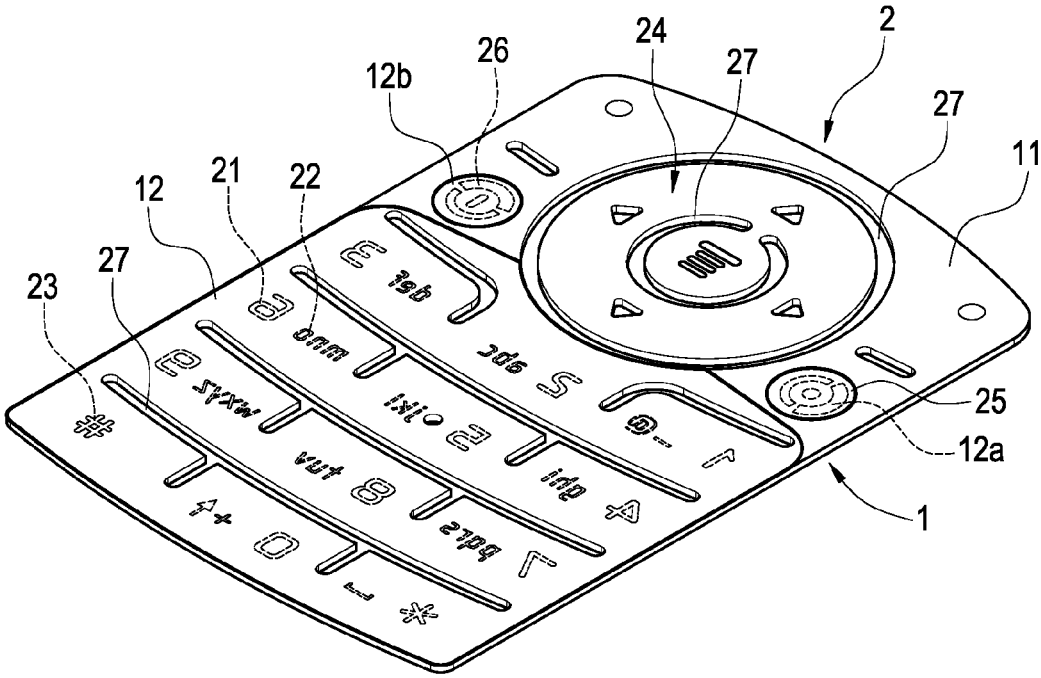
FIG. 4 is a perspective view showing the external appearance of the keypad panel of the present invention.

With reference to FIG. 4, in the step 108, after the printing of each layer is completed, a punching operation is performed on the panel 2 and the grooves 27 of the panel 2 with a punching machine to divide the position of each key. In this way, the manufacturing of the panel is finished.

Figure 5:
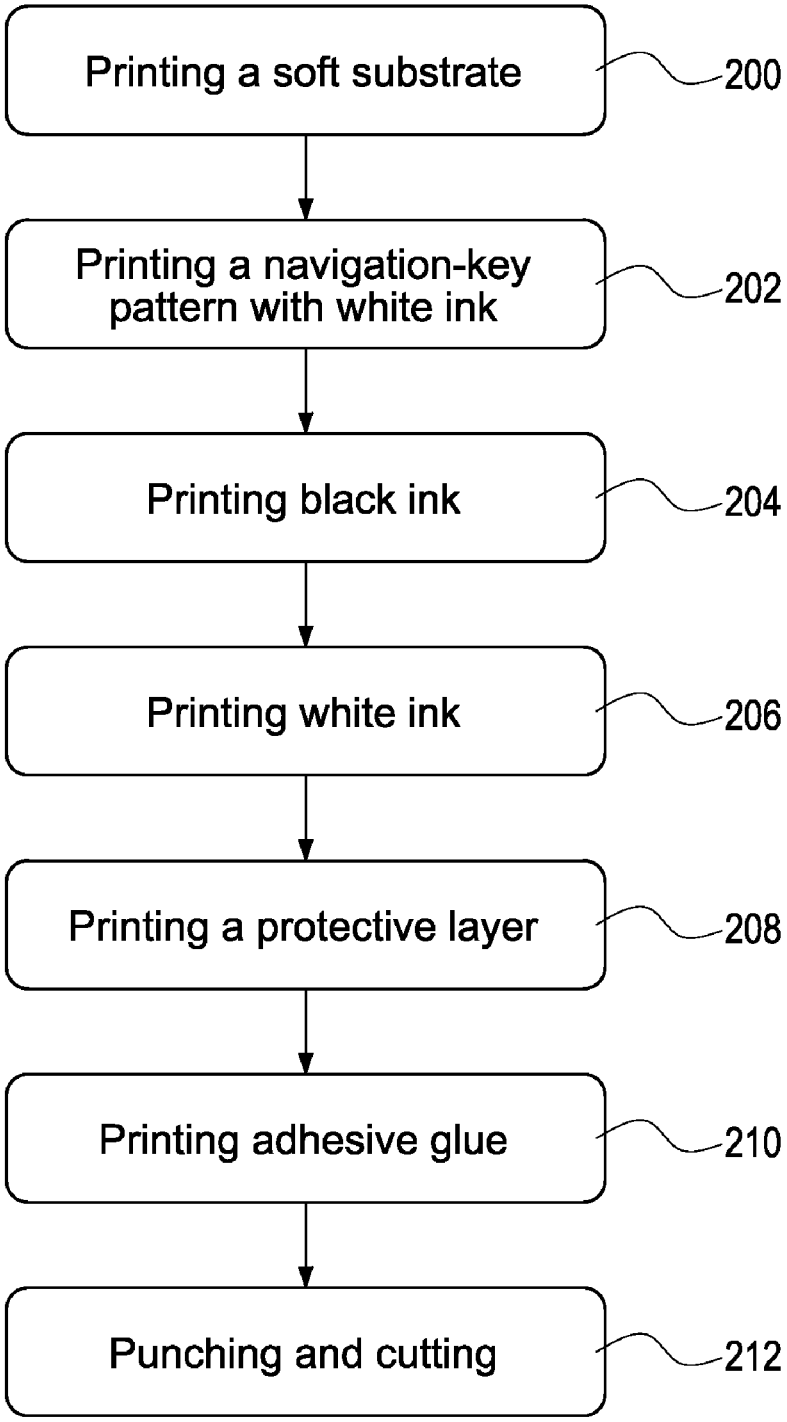
FIG. 5 is a schematic view showing the manufacturing process of the lining sheet of the keypad of the present invention.
Figure 6:
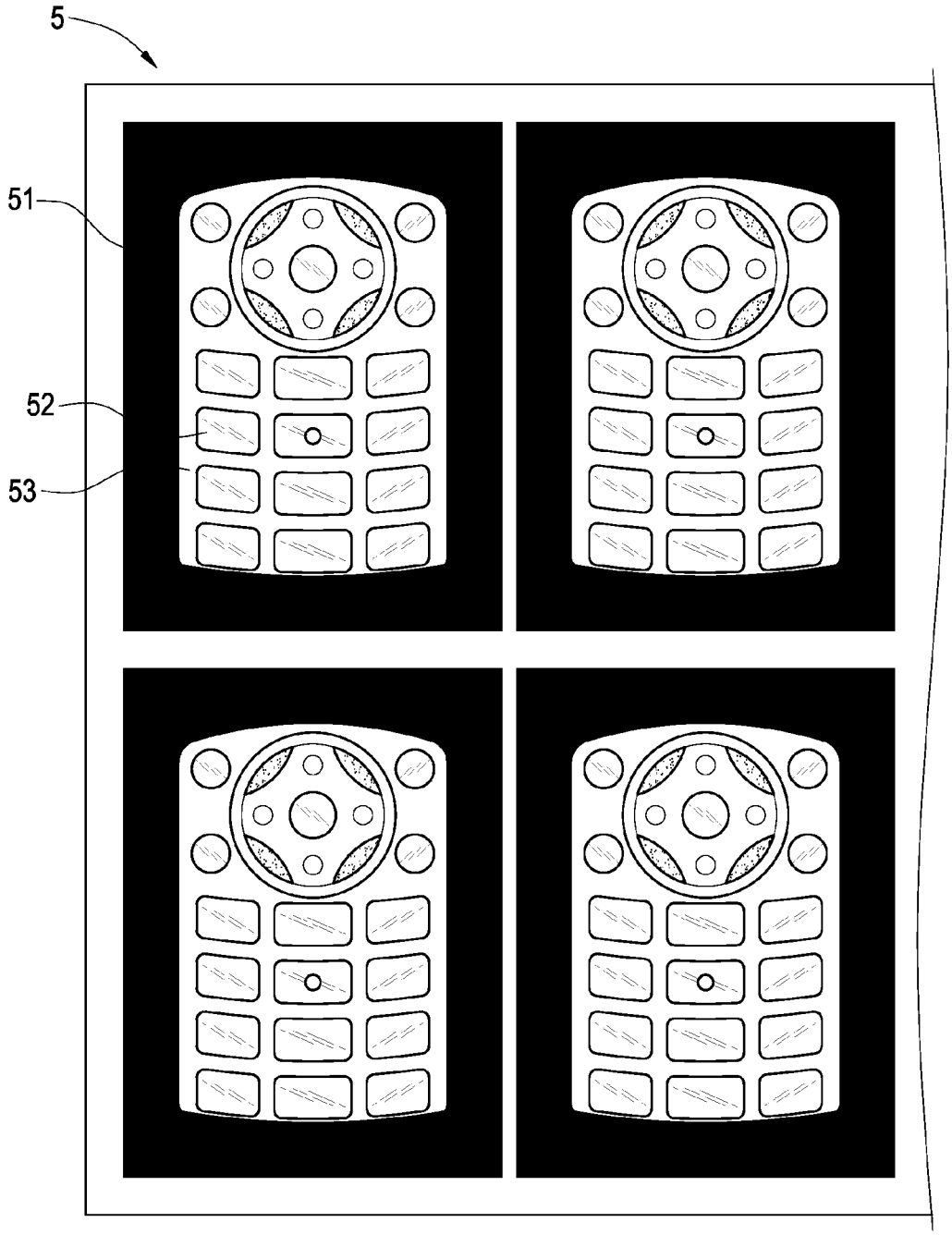
FIG. 6 is a front view of the lining sheet of the keypad of the present invention.

FIG. 5 is a schematic view showing the manufacturing process of the lining sheet of the keypad of the present invention, and FIG. 6 is a front view of the lining sheet of the keypad of the present invention. It can be seen that these drawings disclose a manufacturing process of the lining sheet 5 of the thin keypad of the present invention. First, in the step 200, a transparent soft substrate is prepared. The soft substrate is a TPU film plastic material.

Figure 7A:
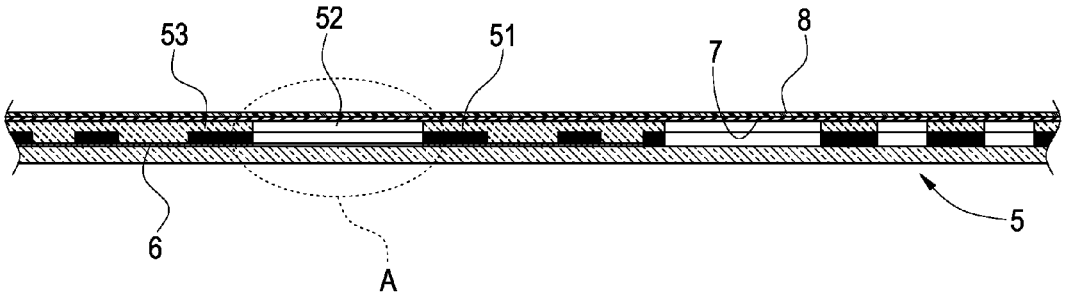
FIG. 7A is a side view of the lining sheet of the keypad of the present invention.
Figure 7B:
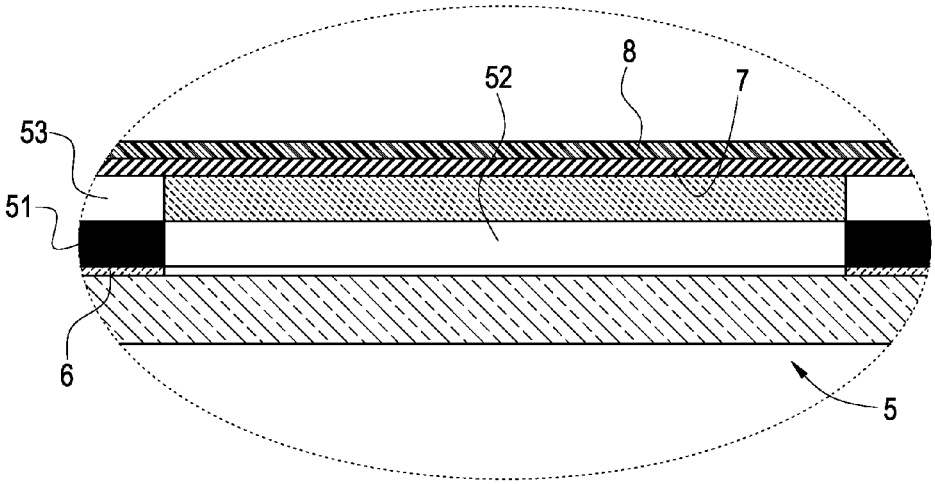
FIG. 7B is a partially enlarged view of FIG. 7A.

With reference to FIGS. 7A and 7B, in the step 202, a layer of white ink is printed on the surface of the soft substrate 5 to form a navigation-key pattern layer 6.

With reference to FIGS. 7A and 7B, in the step 204, a second layer of black ink is printed on the first layer of ink to form a light-shielding layer 51 and a plurality of hollowed and light-transmitting positions 52 corresponding to the numerals 21, English letters 22, various symbols 23, the navigation-key pattern 24, the dialing pattern 25 and the ending pattern 26.

With reference to FIGS. 7A and 7B, in the step 206, a third layer of white ink is printed on the second layer of black ink to form a light-reflecting layer 53.

With reference to FIGS. 7A and 7B, in the step 208, a protective layer 7 is printed on the second layer of black ink. Transparent ink is printed on the lining sheet 5 to form the protective layer 7. The protective layer 7 can prevent the black and white inks from damaging.

With reference to FIGS. 7A and 7B, in the step 210, a layer of adhesive glue 8 is printed on the surface of the protective layer 7. The adhesive glue 8 can be adhered to a light-guiding layer during the subsequent process.

Figure 8:
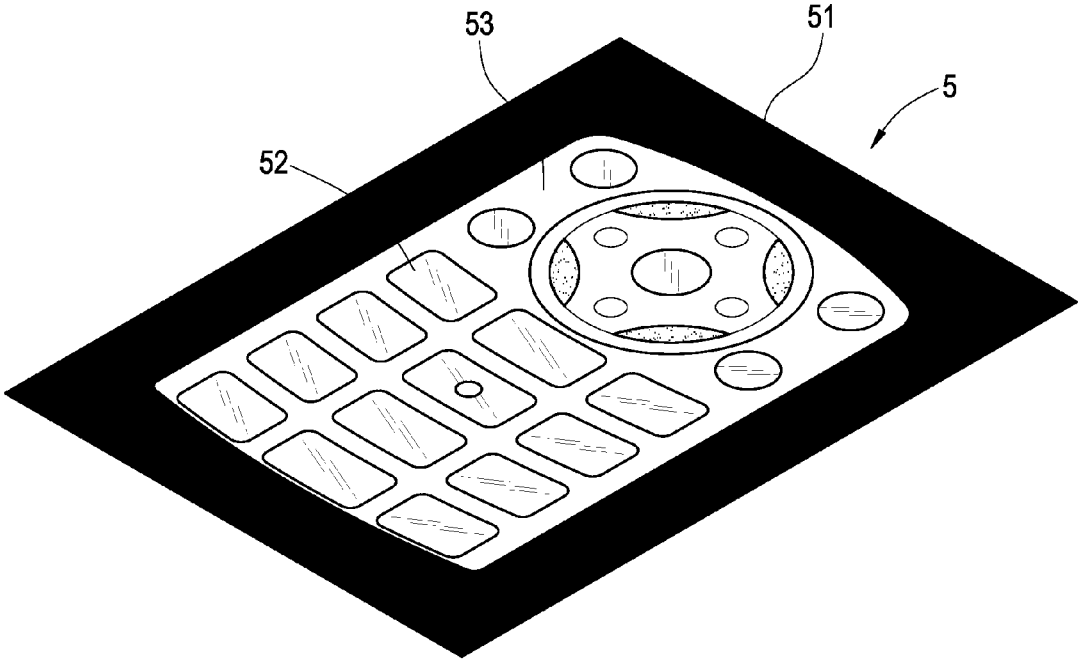
FIG. 8 is a perspective view showing the external appearance of the lining sheet of the keypad of the present invention.

With reference to FIG. 8, in the step 212, after the printing of each layer is completed, the soft substrate is cut with a machine to form a single lining sheet 5, thereby to complete the manufacturing of the lining sheet 5.

Figure 9:
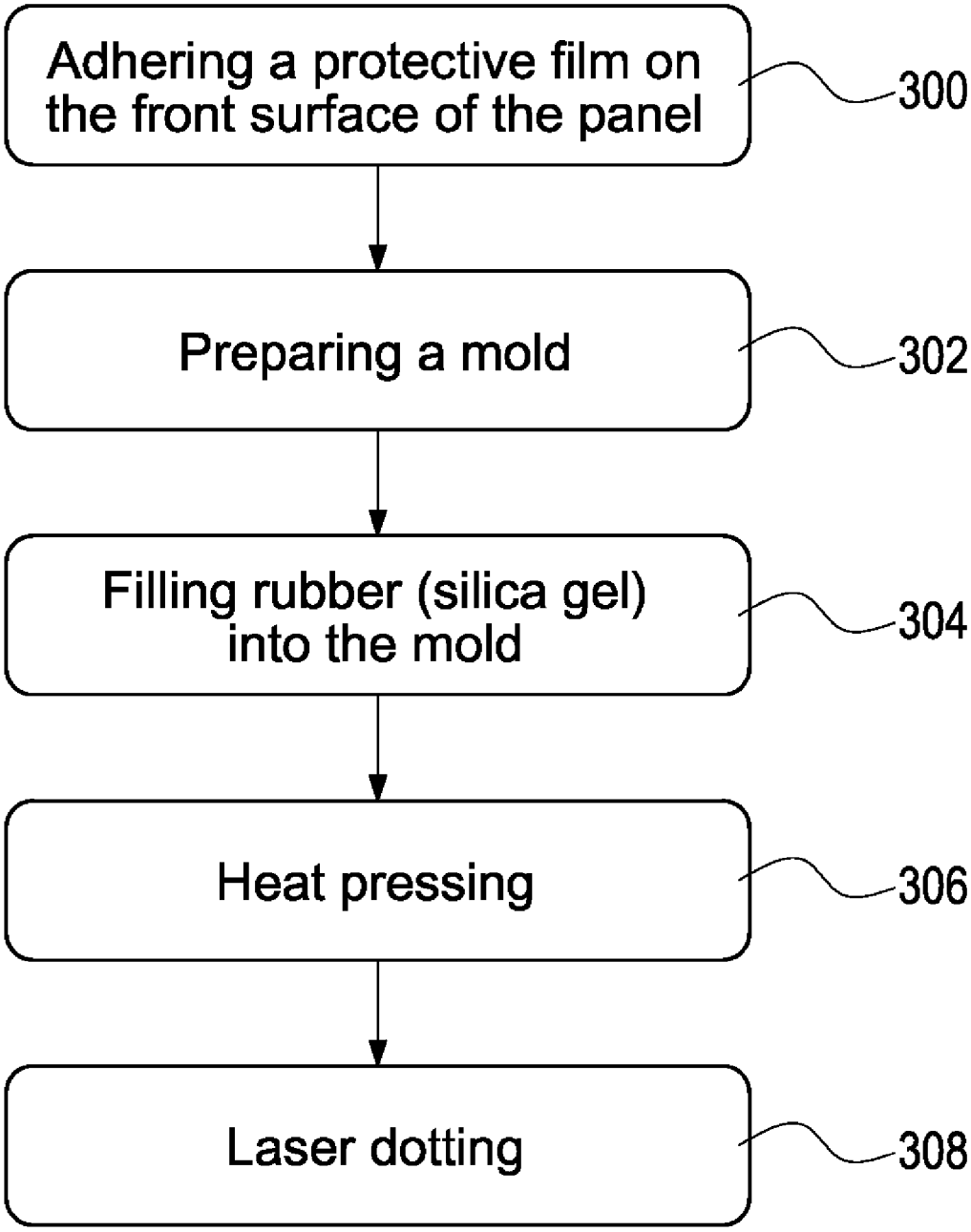
FIG. 9 is a schematic view showing the manufacturing process of the keypad assembly of the present invention.
Figure 10:
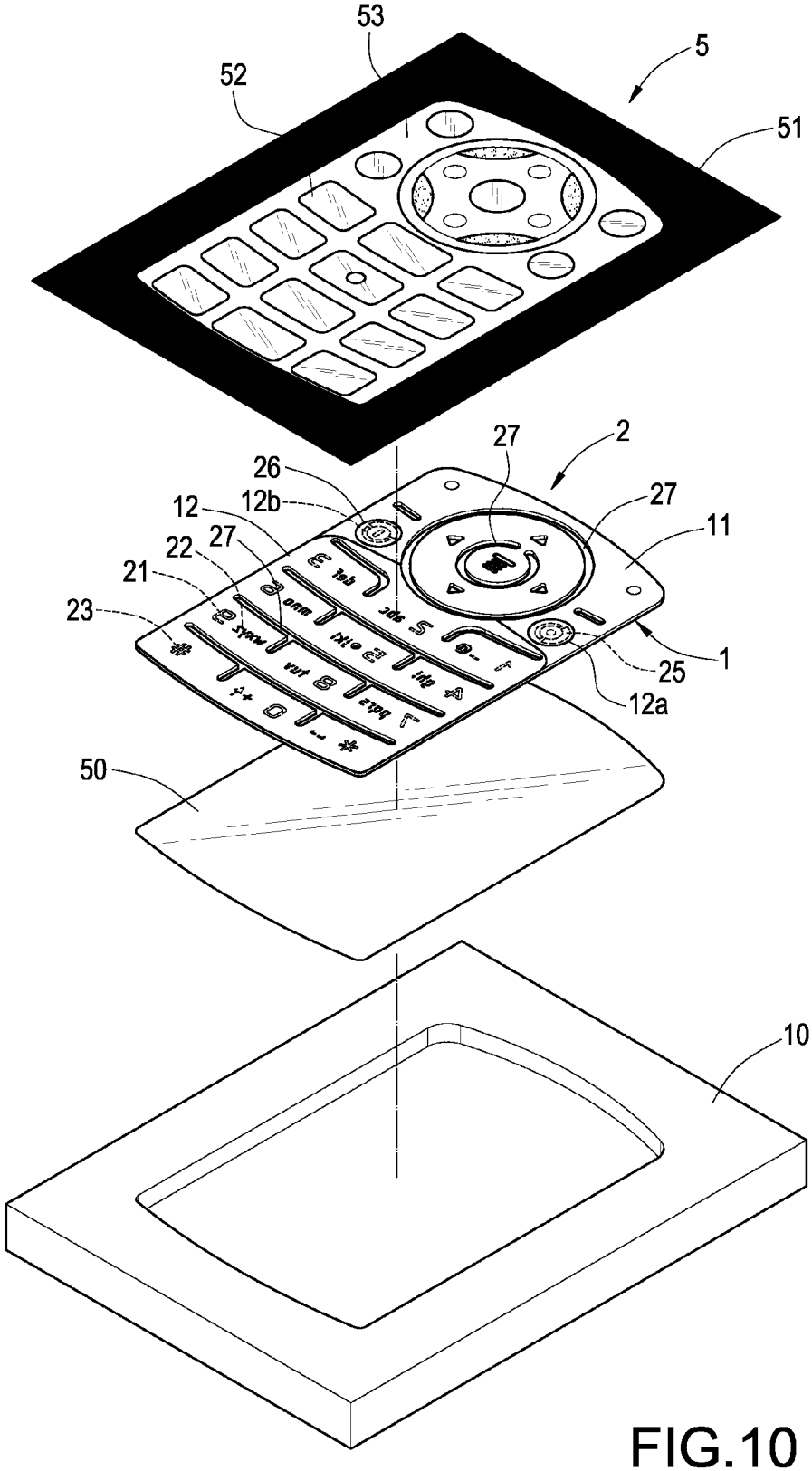
FIG. 10 is a schematic view showing that the keypad assembly of the present invention is disposed in a mold.

FIG. 9 is a schematic view showing the manufacturing process of the keypad assembly of the present invention, and FIG. 10 is a schematic view showing that the keypad assembly of the present invention is disposed in a mold. As shown in the figures, the finished panel 2 and the lining sheet 5 are combined with each other. Further, an elastic light-guiding layer 9 is made in the bottom of the lining sheet 5.

First, in the step 300, before the panel 2 is disposed in the mold 10, the front surface of the panel 2 is adhered with a protective film 50 thereon.

In the step 302, after the adhesive glue 4 of the panel 2 is combined with the lining sheet 5, they are disposed in the mold 10.

In the step 304, rubber (silica gel) is filled into the mold 10.

Figure 11:
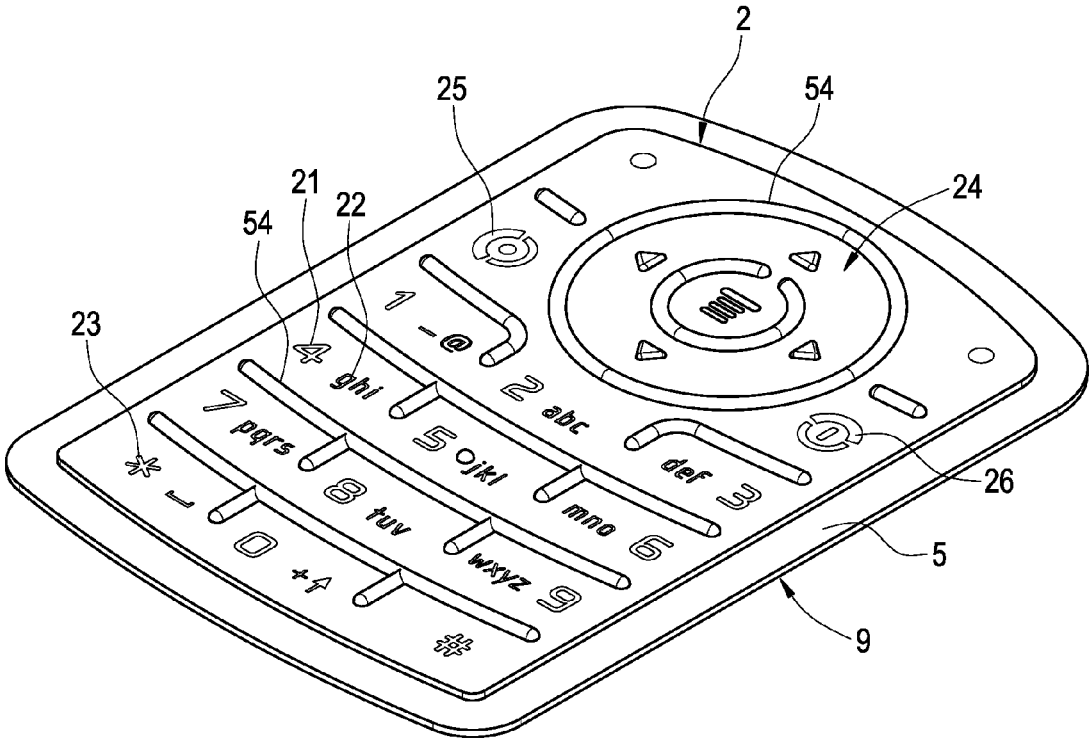
FIG. 11 is a perspective view showing the external appearance of the keypad assembly of the present invention.

With reference to FIG. 11, in the step 306, after the panel 2 is subjected to heat pressing, the rubber (silica gel) is combined with the adhesive glue of the lining sheet 5, and then shaped in the bottom of the lining sheet 5 to form the light-guiding layer 9. At the same time, the rubber (silica gel) together with the light-shielding layer 51 and light-reflecting layer 53 made of black ink are extruded out of the surface of the panel 2 through the grooves 27, thereby to form three-dimensional projecting ribs 54 to divide the positions of each key. Also, a projecting body 91 is formed in the bottom of the light-guiding layer 9 to correspond to each key.

Figure 12:
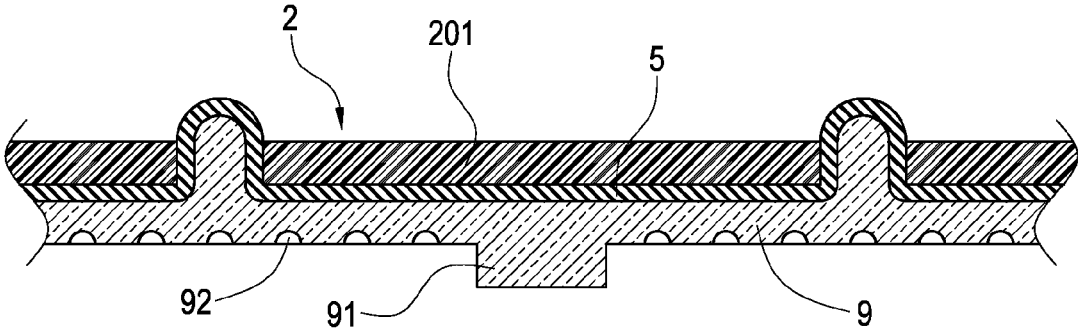
FIG. 12 is a side view of FIG. 11.

With reference to FIG. 12, in the step 308, after the combination of the panel 2 with the lining sheet 5 and the light-guiding layer 9 is completed, they are taken out of the mold 10 and then dotted by laser to form a plurality of pitted light-guiding micro structures 92 on the surface of the light-guiding layer 9 corresponding to the projecting body 91 or the peripheral positions of the projecting body 91. The light-guiding micro structures 92 can pass through the hollowed light-transmitting positions 52 by means of the condensing and refraction of a light source. In this way, the numerals 21, English letters 22, various symbols 23, the navigation-key pattern 24, the dialing pattern 25 and the ending pattern 26 on the panel 2 can have a light-transmitting effect.

Figure 13:
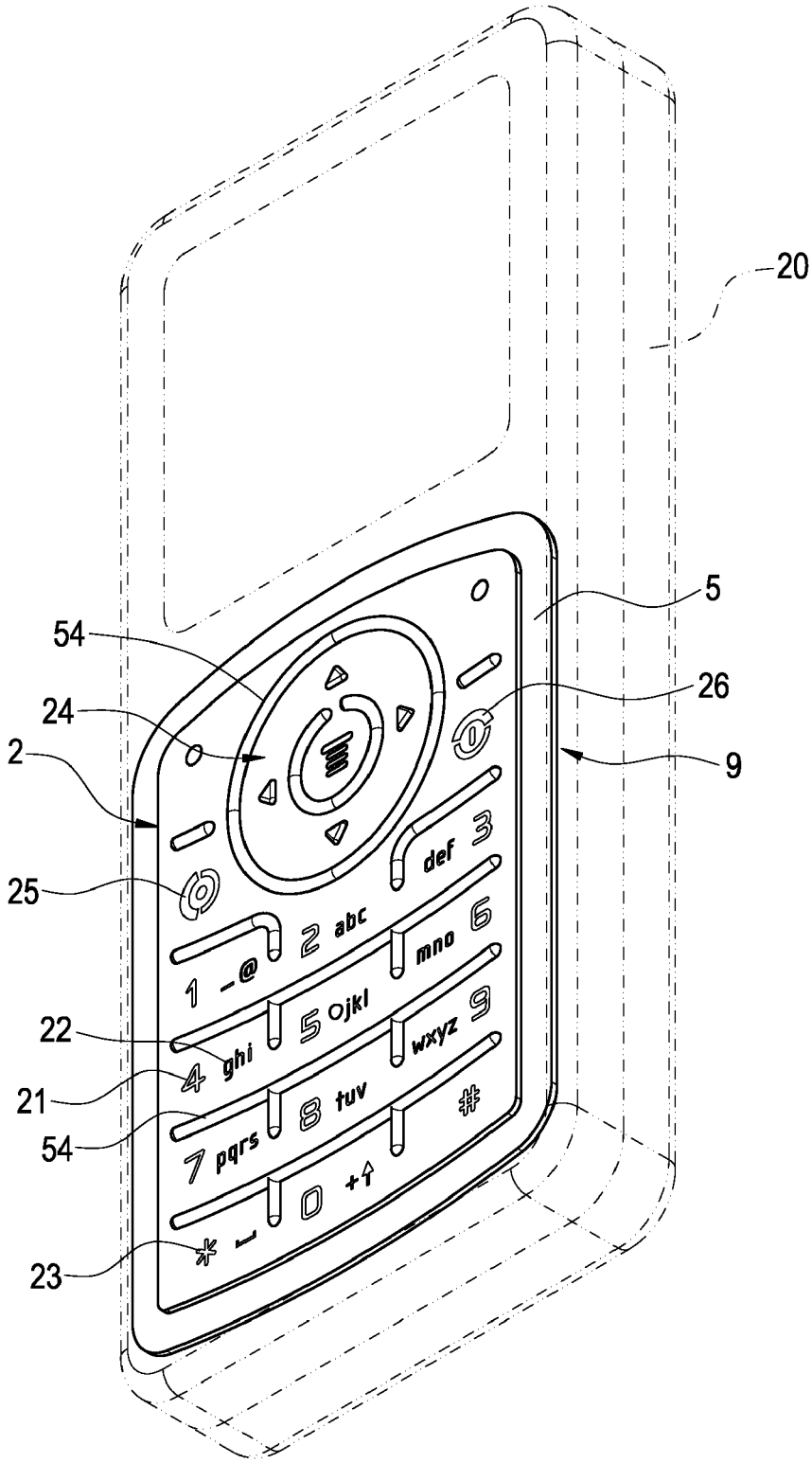
FIG. 13 is a perspective view showing the external appearance in which the keypad assembly of the present invention is mounted on a mobile phone.

With reference to FIG. 13, it is a perspective view showing the external appearance in which the keypad assembly of the present invention is mounted on a mobile phone. As shown in the figure, after the finished keypad of the present invention is combined with a mobile phone 20, the projecting ribs 54 on the panel 2 eliminate the seams between the keys. Therefore, the foreign matters (such as dust and fine particles) and water will not penetrate into the keypad, thereby to keep the surface of the panel 2 clean.

Figure 14:
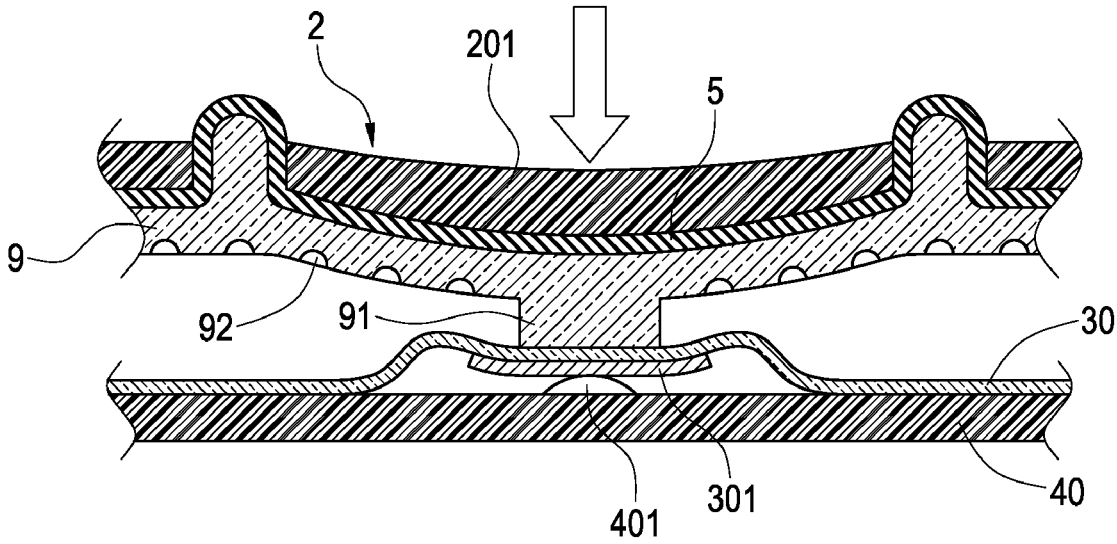
FIG. 14 is a schematic view showing the operating state of the keypad assembly of the present invention.

With reference to FIG. 14, it is a schematic view showing the operating state of the keypad assembly of the present invention. As shown in the figure, when the keypad assembly of the present invention is in use, it is disposed on an dome sheet 30. The dome sheet 30 has a plurality of metal domes 301 thereon to correspond to the projecting bodies 91 of the light-guiding layer 9. A thin film circuit board 40 is provided below the dome sheet 30. The thin film circuit board 40 has a plurality of conductive contacts 401 thereon to correspond to the metal domes 301.

When the surface of the keycap 201 of the panel 2 is pressed by an external force, the keycap 201, lining sheet 5 and the light-guiding layer 9 are deformed, so that the projecting bodies 91 of the light-guiding layer 9 may press on the surface of the dome sheet 30. In this way, the metal domes 301 may be deformed and brought into contact with the conductive contacts 401 of the thin film circuit board 40, thereby to produce an input of conductive signal. The pattern generated by the signal will be displayed on the displaying screen of the mobile phone.

Figure 15:
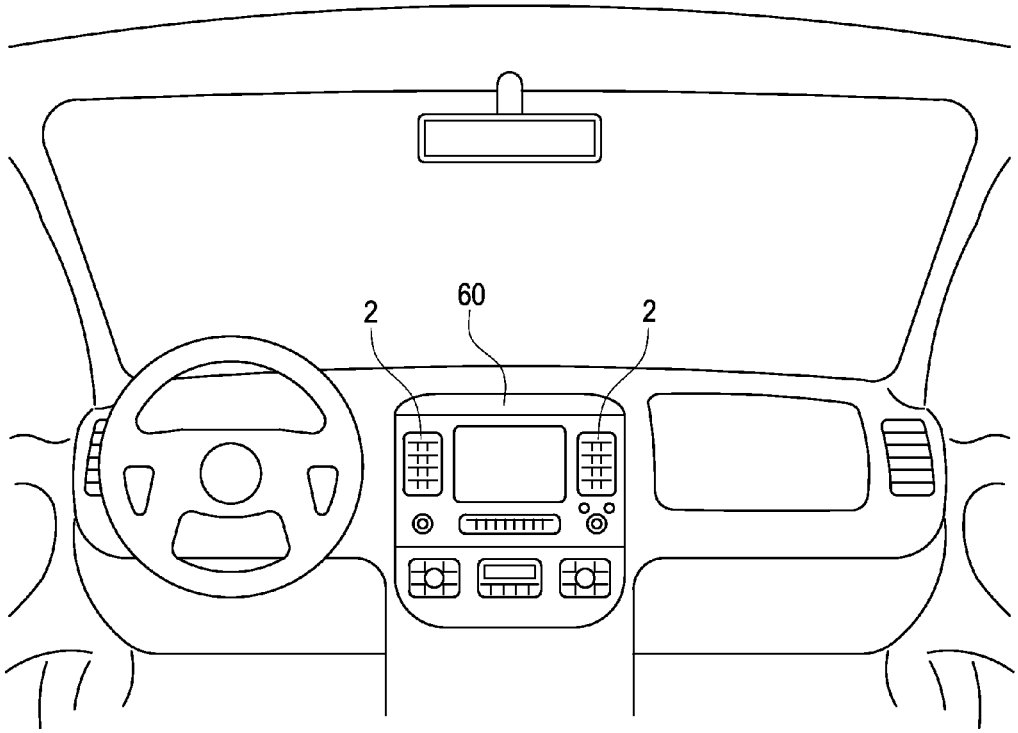
FIG. 15 is a schematic view of another embodiment of the present invention.
Figure 16:
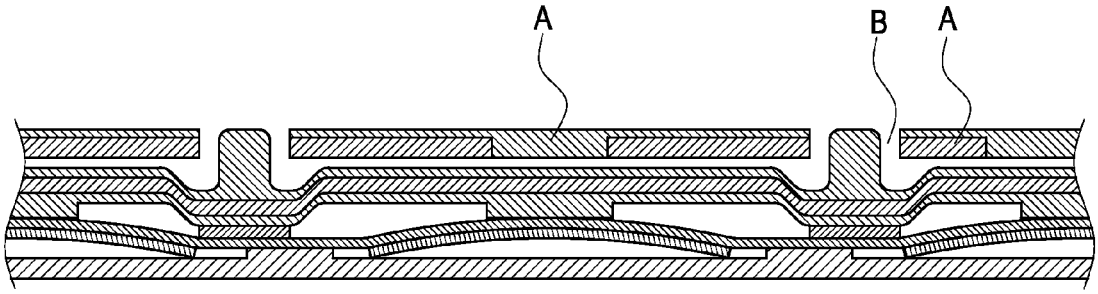
FIG.16 PRIOR ART
FIG. 16 is a view of U.S. Pat. No. 7,070,349 B2.
Figure 17:
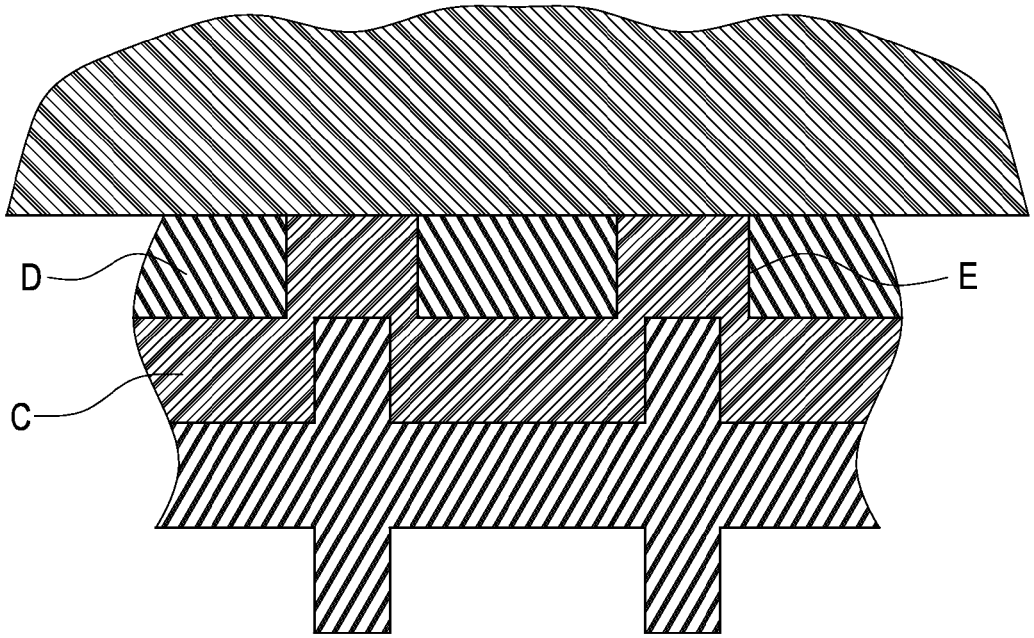
FIG.17 PRIOR ART
FIG. 17 is a view of Taiwan Patent Certificate No. 1252159.

With reference to FIG. 15, it is a schematic view showing that the keypad assembly of the present invention is applied to an automotive dashboard. As shown in the figure, in addition to be applied to a mobile phone, the panel 2 of the keypad assembly of the present invention can be mounted on the automotive dashboard 60, whereby to control the air-conditioning system, audio and video system and satellite navigation system.

Although the present invention has been described with reference to the foregoing preferred embodiments, it will be understood that the invention is not limited to the details thereof Various equivalent variations and modifications can still be occurred to those skilled in this art in view of the teachings of the present invention. Thus, all such variations and equivalent modifications are also embraced within the scope of the invention as defined in the appended claims.

What is claimed is:

1. A thin keypad assembly, comprising:

a panel having thereon hollowed keys selected from numerals, letters, various symbols, a navigation-key pattern, a dialing pattern and an end pattern, and grooves formed between the keys;

a lining sheet disposed on the panel and having the navigation-key pattern thereon, the navigation-key pattern having a light-shielding layer and light-transmitting positions thereon, and the light-shielding layer having a light-reflecting layer thereon; and a light-guiding layer disposed on the lining sheet, a position thereof corresponding to one key having a plurality of light-guiding micro structures and projecting bodies, wherein the light-guiding layer, light-shielding layer and the light-reflecting layer extend above a surface of the panel through the grooves.

2. The thin keypad assembly according to claim 1, wherein the keys on the panel having hollowed numerals, letters, various symbols and the navigation-key pattern are formed with white ink.

3. The thin keypad assembly according to claim 1, wherein one key having the dialing pattern is formed with green ink.

4. The thin keypad assembly according to claim 1, wherein one key having the end pattern is formed with red ink.

5. The thin keypad assembly according to claim 1, wherein the light-shielding layer is black ink.

6. The thin keypad assembly according to claim 1, wherein the light-reflecting layer is white ink.

7. The thin keypad assembly according to claim 1, wherein the light-guiding layer is silica gel.

8. The thin keypad assembly according to claim 1, wherein the light-guiding micro structures are pitted.

* * * * *